US008549940B2

(12) United States Patent
Darr et al.

(10) Patent No.: US 8,549,940 B2
(45) Date of Patent: Oct. 8, 2013

(54) DRIVE SYSTEM OF A FORMING PRESS

(75) Inventors: Uwe Darr, Erfurt (DE); Steffen Schmidt, Urbich (DE); Edwin Goetz, Bad Waldsee (DE); Gerhard Voegel, Sigmarszell (DE); Wolfgang Meinhardt, Hohenkirchen (DE)

(73) Assignee: Mueller Weingarten AG, Weingarten (DE)

( * ) Notice: Subject to any disclaimer, the term of this patent is extended or adjusted under 35 U.S.C. 154(b) by 973 days.

(21) Appl. No.: 12/308,145

(22) PCT Filed: Jun. 7, 2007

(86) PCT No.: PCT/DE2007/001009

§ 371 (c)(1),
(2), (4) Date: Mar. 30, 2009

(87) PCT Pub. No.: WO2007/140765

PCT Pub. Date: Dec. 13, 2007

(65) Prior Publication Data

US 2009/0260460 A1 Oct. 22, 2009

(30) Foreign Application Priority Data

Jun. 8, 2006 (DE) ..... 10 2006 026 996
Jun. 6, 2007 (DE) ..... 10 2007 026 727

(51) Int. Cl.
*F16H 21/18* (2006.01)

(52) U.S. Cl.
USPC ..... 74/49

(58) Field of Classification Search
USPC ..... 74/49, 44, 412 R, 413; 100/35, 48, 273, 100/282; 72/443, 441, 429
See application file for complete search history.

(56) References Cited

U.S. PATENT DOCUMENTS

| | | | | |
|---|---|---|---|---|
| 2,550,063 | A * | 4/1951 | Johansen | 72/417 |
| 4,607,732 | A * | 8/1986 | Ikeoka et al. | 192/12 R |
| 5,048,410 | A * | 9/1991 | Teramoto et al. | 100/48 |
| 5,069,060 | A * | 12/1991 | Ishii | 72/443 |
| 5,720,201 | A * | 2/1998 | Yoshida et al. | 74/44 |
| 5,782,132 | A * | 7/1998 | Ishibashi et al. | 74/44 |
| 6,067,886 | A * | 5/2000 | Irwin | 83/615 |
| 6,520,075 | B1 * | 2/2003 | Shinoda et al. | 100/214 |
| 6,595,125 | B2 * | 7/2003 | Kawado et al. | 100/282 |
| 6,805,045 | B1 * | 10/2004 | Korner et al. | 100/193 |
| 7,102,316 | B2 * | 9/2006 | Beyer et al. | 318/625 |

(Continued)

FOREIGN PATENT DOCUMENTS

| | | |
|---|---|---|
| DE | 198 42 278 | 3/2000 |
| DE | 199 32 990 | 9/2000 |
| DE | 101 35 663 | 2/2003 |
| DE | 10 2004 009 256 | 9/2005 |
| JP | 2003-112300 | 4/2003 |
| JP | 2003-290997 | 10/2003 |

(Continued)

*Primary Examiner* — Troy Chambers
*Assistant Examiner* — Jude Agendia
(74) *Attorney, Agent, or Firm* — Jordan and Hamburg LLP

(57) ABSTRACT

In a drive system of a forming press for driving the plunger with a crank mechanism controllable by a servomotor, the torques of the servomotors that are required to achieve a high pressure force for the plunger by means of intermediate gearing, preferably with a double gear transmission, to the cam or crank mechanism, wherein the symmetrically configured drive arms of multipoint presses for the right and the left pressure points of two-point presses or the pressure point groups of four-point presses are optionally mechanically synchronized with one another in such a way that each of the intermediate gears of the first or of one of the first gear transmissions is effectively connected to the others.

20 Claims, 14 Drawing Sheets

(56) References Cited

U.S. PATENT DOCUMENTS

| | | | | |
|---|---|---|---|---|
| 7,165,437 | B2 * | 1/2007 | Shin et al. | 72/417 |
| 7,357,073 | B2 * | 4/2008 | Aoshima | 100/48 |
| 2004/0003729 | A1 | 1/2004 | Aoshima | |
| 2005/0189900 | A1 | 9/2005 | Beyer et al. | |

FOREIGN PATENT DOCUMENTS

| | | |
|---|---|---|
| JP | 2004-025287 | 1/2004 |
| JP | 2005-271070 | 10/2005 |
| JP | 2006-061974 | 3/2006 |
| WO | WO-2006/045279 | 5/2006 |

* cited by examiner

DRIVE SYSTEM OF A FORMING PRESS

BACKGROUND OF THE INVENTION

The invention relates to a drive system for a multi-point forming press.

Known according to DE 10 2004 009 256 is a mechanical multi-servo-press in which the servo-motors with associated pinions as a single-stage gear at spaced apart locations each drive an eccentric wheel for driving a slide having two pressure points. At great pressing forces, high torques for the servo-motors are necessary due to the limited transmission ratio of the single-stage gear. In this regard, the document discloses that the load on the servo-motors can be reduced by using the momentum of the mass moment of inertia of the gear. Since this effect can only be used at elevated speeds, at low speeds the servo-motors would be underdimensioned for applying the installed pressing force, especially in set-up mode.

The intermediate gears that connect the eccentric wheels and that are also necessary for mechanical synchronization in the gear result in increased complexity.

Brake motors are suggested for braking and stopping the slide. Due to the limited transmission ratio of the single-stage gear, elevated braking torques are necessary, which increases the mass moment of inertia. Not disclosed are means required for attaining a safety category necessary for press operation, including possible locking of the slide.

Known in accordance with WO 2004/056559 is another pressing device having a pressure point, in which device a direct drive, in the form of a frequency-controlled AC motor, which is arranged directly on the eccentric shaft, controls the movement of the slide. The limited available torques of the servo-motor enable relatively low pressing forces without any intermediate gearing.

For operational on/off movements for the press device, emergency off devices are provided via the motor control and/or mechanical devices, but the structure required for satisfying safety requirements and their functions is not disclosed.

JP 2006061974 describes a drive system for a multi-point forming press, each of the crank wheels of which can be driven via a two-stage transmission by means of a separately controllable servo-motor, the first gear stage being embodied as a flexible drive, the traction means of which have different lengths between the front and rear pressure point group in a four-point press.

In another multi-point forming press in accordance with JP 2005271070, each drive wheel separately associated with each pressure point and connected to a crank is driven via one or two single-stage toothed wheel gears by a servo-motor, in the case of a four-point press it being possible for the drive for the two drive wheels belonging to one pressure point group to come from one or alternatively two common single-stage gears.

The last two documents cited do not disclose means required for attaining a safety category necessary for press operation, including possible locking of the slide.

Known from DE 199 32 990 is a slide locking and slide release device, for a conventional mechanical press equipped with a flywheel and a clutch/brake combination, in which device a non-positive fit additional brake that is controlled independently of the main brake is arranged on a central shaft, the function of which is monitored cyclically and redundantly for satisfying safety requirements and is integrated into the press safety control unit.

Known from DE 199 10 965 is another locking device for a press slide, in which device the stepless locking of a main drive shaft, which where necessary acts on a plurality of slides simultaneously, is attained using outer and inner teeth that can be caused to engage by means of a positioning device.

DE 101 35 663 describes a positive fit mechanical restraint device that is on a brake device and in which a gear ring is borne rotation-fast in the mutual guide of the outer disks of a multi-disk brake and can be longitudinally displaced in a counter-gear ring, said counter-gear ring being able to perform a rotary movement for positive-fit coupling.

None of these last three publications cited discloses applications in servo-presses that are largely free of flywheels and clutches.

Known from DE 102 44 318 is a press having a servo-spindle drive, the drive movement of which can be braked using a brake motor and/or using a mechanical brake device.

JP 2003290997 discloses a single-point forming press, the drive wheel of which is connected to a crank and can be actuated via a single-stage gear by a servo-motor, a brake borne on the frame side being provided between the servo-motor and the drive wheel.

The measures of the last two publications cited are not adequate for satisfying engineering and personnel safety requirements for presses in order to be classified in a defined safety category.

SUMMARY OF THE INVENTION

The underlying object of the invention is to configure a drive system for a multi-point forming press such that on the one hand high pressing forces can be attained using the available torques of servo-motors and on the other hand to reduce the technical complexity both in the design of the drive having a plurality of mechanically synchronized pressure points and also in the design of the drive having pressure points that can be controlled independent of one another. The intent of the latter design is in particular spatial tilt control for the slide in two planes when using a forming press embodied with four pressure points. Moreover, the mechanical and personnel safety requirements for the press that can be controlled by one or a plurality of servo-motors are to be satisfied.

The core idea of the invention is to transfer the torques required for high pressing force for the slide from the servo-motors via intermediate gears, preferably dual gear transmissions, to the eccentric or crank mechanisms, in multi-point presses the symmetrically configured drive arms for the right-hand and left-hand pressure points on two-point presses or pressure point groups on four-point presses being selectively mechanically synchronizable with one another such that the intermediate gears of the first gear transmission or of one of the first gear transmissions are mechanically linked. It is likewise conceivable to drive each eccentric or crank mechanism, which belong separately to one pressure point of a four-point press, using a single gear transmission, so that spatial tilt control of the slide is possible in two planes.

In addition, in a first design type the pinion shafts, which are allocated separately to each crank wheel and can be controlled by means of a servo-motor, are arranged radially offset to one another such that the pinion shafts on the one hand are connected to a servo-motor borne on the frame side and on the other hand to a retention device borne on the frame side. The servo-motors and retention devices can each be arranged together on one side or preferably in a mirror-image of one another with regard to the adjacent, successive pressure points.

Moreover, it is conceivable to use a single gear transmission to drive separately crank wheels jointly allocated to the two pressure point groups of a four-point press so that tilt control for the slide is only possible in one plane.

If tilt control that can be controlled by the slide drive is omitted, this embodiment can be converted to a forming press with alternative positioning of the drive shafts in the longitudinal direction in that a single gear transmission drives a crank wheel jointly allocated to the two pressure points of a two-point press.

In a second design type each crank wheel is driven by a first servo-motor-driven pinion shaft, mechanical synchronization of the right and left pressure points, or pressure point groups, belonging to a multi-point press being possible by means of the intermediate gears arranged coaxially on the pinion shafts.

For higher outputs, in a third design type a second gear transmission is mechanically linked on the one hand to each servo-motor-driven first gear transmission and on the other hand via a second pinion shaft to the associated crank wheel. The intermediate gears that belong to the first gear transmission and that are each arranged coaxially on the second pinion shaft can be mechanically linked for the purpose of selective mechanical synchronization of the pressure points. In a fourth design type, in order to divide the torque introduced into the crank wheel, it is possible to employ, per crank wheel, two second pinion shafts, the intermediate gears of which are arranged coaxially and belong to the first gear transmission and are spaced apart such that they can be driven jointly by a servo-motor-driven first pinion shaft. In this case as well, the coaxially arranged intermediate gears of one of the pressure points adjacent to the second pinion shaft can be mechanically linked to one another for the purpose of mechanical synchronization.

In one advantageous embodiment, axially displacing these intermediate gears and the associated pinion can select and deselect the mechanical link between the pressure points.

In a fifth design type, the crank wheels of the adjacent pressure points or pressure point groups can be centrally driven via a single or preferably dual gear transmission by one or a plurality of servo-motors with a power split via an intermediate gear that mechanically synchronizes the crank wheels. In one advantageous design, in a single gear transmission the pinion shaft, which acts on the one hand on one of the two crank wheels and on the other hand on the intermediate gear that synchronizes the crank wheels, can be driven by a servo-motor borne on the first end, the associated retention device being borne on the second end.

In another embodiment of this design type having dual gear transmissions, the pinion shaft of the embodiment described in the foregoing is driven by a first gear transmission such that the first pinion shaft belonging to the first gear transmission is mechanically linked on the one hand to a servo-motor and on the other hand to a retention device.

Moreover, it is possible for the pinion shaft of the first gear transmission to be connected to opposing servo-motors borne on the frame side and for the associated retention device to be mechanically linked to the pinion shaft of the second gear transmission or of the intermediate gear.

Likewise, it is conceivable for the torque introduced into the second gear transmission to be divided in that two first pinion shafts arranged radially offset to one another act jointly on the toothed wheel that belongs to the second gear transmission, the first pinion shafts being connected on the one hand to a servo-motor borne on the frame side and at least one first pinion shaft on the other hand being connected to a retention device borne on the frame side.

For further reducing the drive torque it is possible to arrange between the crank wheels and pressure points of the slide a lever mechanism that creates a transmission.

For satisfying the engineering and personnel safety requirements for servo-presses, which compared to conventional presses do not have any clutch/brake combination between motor and transmission, it is furthermore essential to the invention that the servo-motor or servo-motors are mechanically linked to a combination made of a mechanical retention device and a device for electrical torque isolation. Either two independently acting non-positive fit safety brakes in the form of rotation and/or linear brakes or at least one non-positive fit safety brake and one positive fit blocking device in the form of a rotation and/or linear blocking unit are used for the mechanical retention devices. Depending on design type, the rotation brake and rotation blocking unit can advantageously be arranged coaxially on the free shaft end that opposes the servo-motor, it advantageously being possible to use the position on the high-speed shaft allocated to the servo-motor for reducing the braking and blocking torque. In contrast, linear brakes and linear blocking units can be arranged between the frame and the slide that can be moved linearly.

The electrical torque isolation unit is necessary to prevent the servo-motors from starting up in an uncontrolled manner. To this end, in a first embodiment a line contactor that can be turned off is provided in the servo-converter system. A power contactor that can be turned off and that is in the motor line can be used in a second embodiment. In a third embodiment, a turn-off element for the control energy for the semi-conductor valves of the motor inverter is used for the torque isolation unit.

Depending on the categorization of the press in a defined safety category, the devices in each embodiment can be redundant, it also being conceivable to combine a plurality of these embodiments.

The invention is explained in greater detail in the following using exemplary designs and associated drawings.

DETAILED DESCRIPTION OF THE INVENTION

Figure 1:
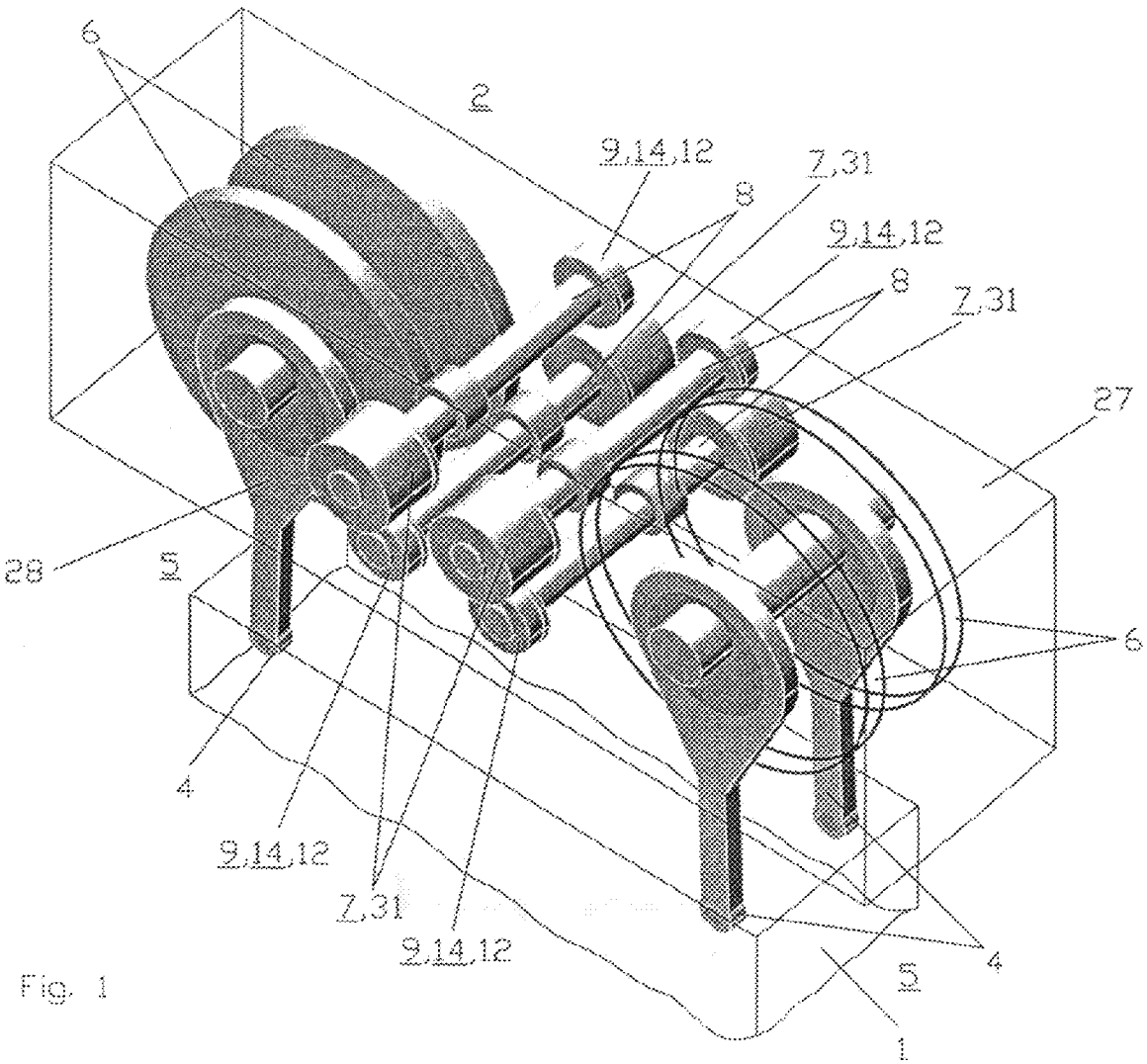
FIG. 1 depicts a drive system for a forming press in accordance with a first design type in a first embodiment having four electronically synchronizable pressure points.
Figure 13:
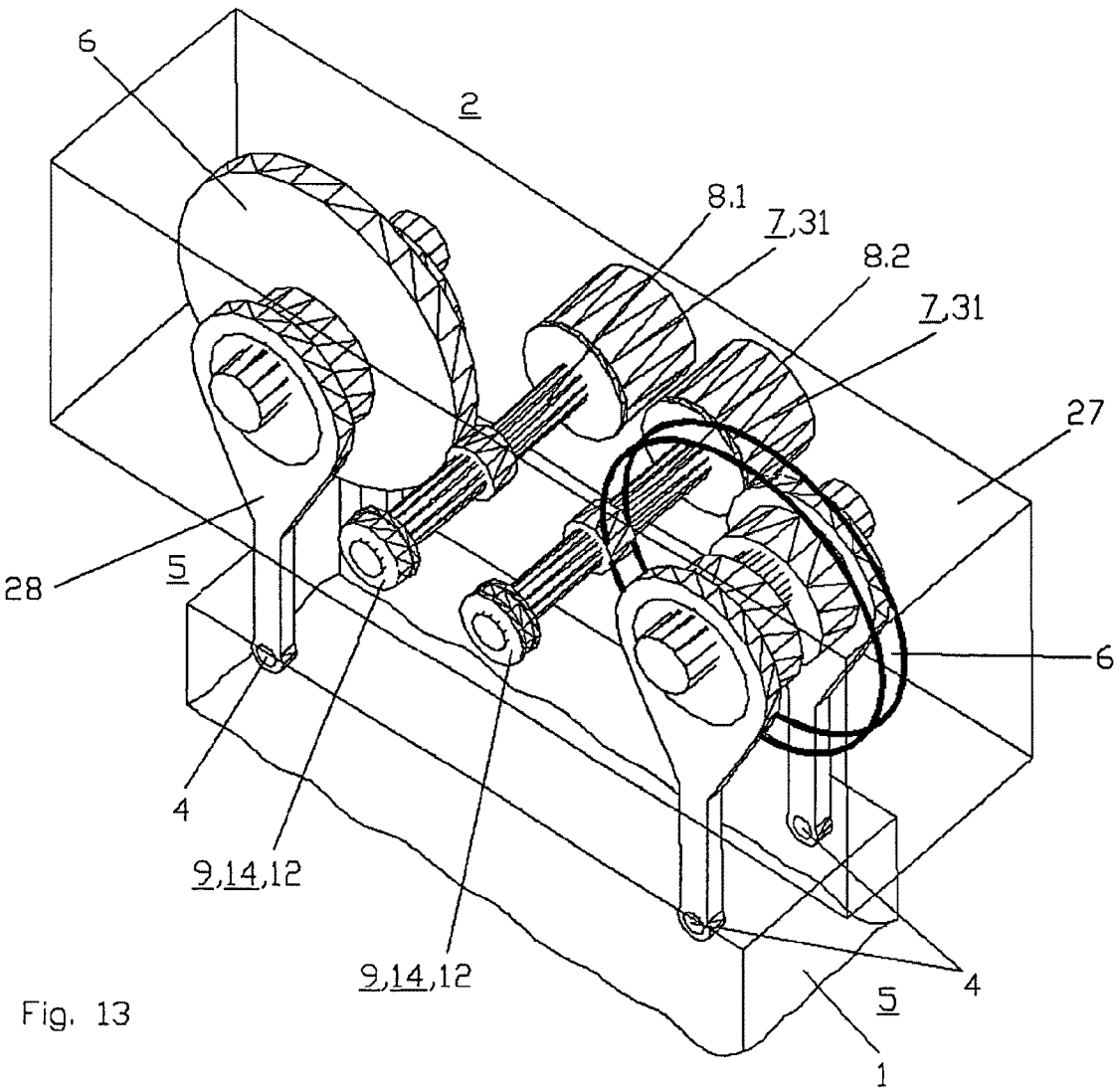
FIG. 13 depicts a drive system for a forming press in accordance with a first design type in a second embodiment having two electronically synchronizable pressure point groups.

In a first exemplary embodiment of the first design type, FIG. 1 depicts a four-point forming press, the drive 2 of which occurs on the four pressure points 4 of the slide 1 by means of a crank mechanism 3, each pressure point 4 being driven separately. The crank mechanism 3 for each pressure point 4 comprises a crank wheel 6 that is borne in the head piece 27 and that is connected on the output side via an eccentrically attached connecting rod 28 to the pressure point 4 of the slide 1 and on the drive side to a first pinion shaft 8. In the second exemplary embodiment of the first design type in accordance with FIG. 13, a common crank wheel 6 that is connected on the drive side to a first pinion shaft 8.1, 8.2 is allocated to the two pressure points 4 in a pressure point group 5. What these two exemplary embodiments have in common is that the first pinion shaft 8 borne in the head piece 27 can be controlled by a freely programmable servo-motor 7 arranged at the first shaft end thereof. (By "controlled" is meant directly controlled or driven.) The servo-motor is advantageously embodied as a hollow shaft motor. The second shaft end is mechanically linked to a retention device 9 borne on the frame side. In accordance with FIG. 1, the first pinion shafts 8 of the crank wheels 6 that are placed one after the other and that are allocated to each pressure point group 5 are arranged radially offset to one another such that the servo-motors 7 for the drive of the front pressure points 4 are borne on the front side and the retention devices 9 are borne on the back side of the head piece 27. For the back pressure points 4, the servo-motors 7 are borne on the back side and the associated retention devices 9 are borne on the front side of the head piece 27. The retention devices 9 are embodied as rotation brakes 14, preferably as non-positive fit safety brakes 12.

The separately controllable servo-motors 7 can on the one hand produce a synchronous movement of the slide 1 using electronic coupling and on the other hand, using an asynchronous movement, can equalize tilting of the slide 1 due to the elastic resilience given an eccentric load or can produce a target tilt position, spatial tilt regulation of the slide 1 in two planes being possible using the four-point embodiment.

Figure 14:
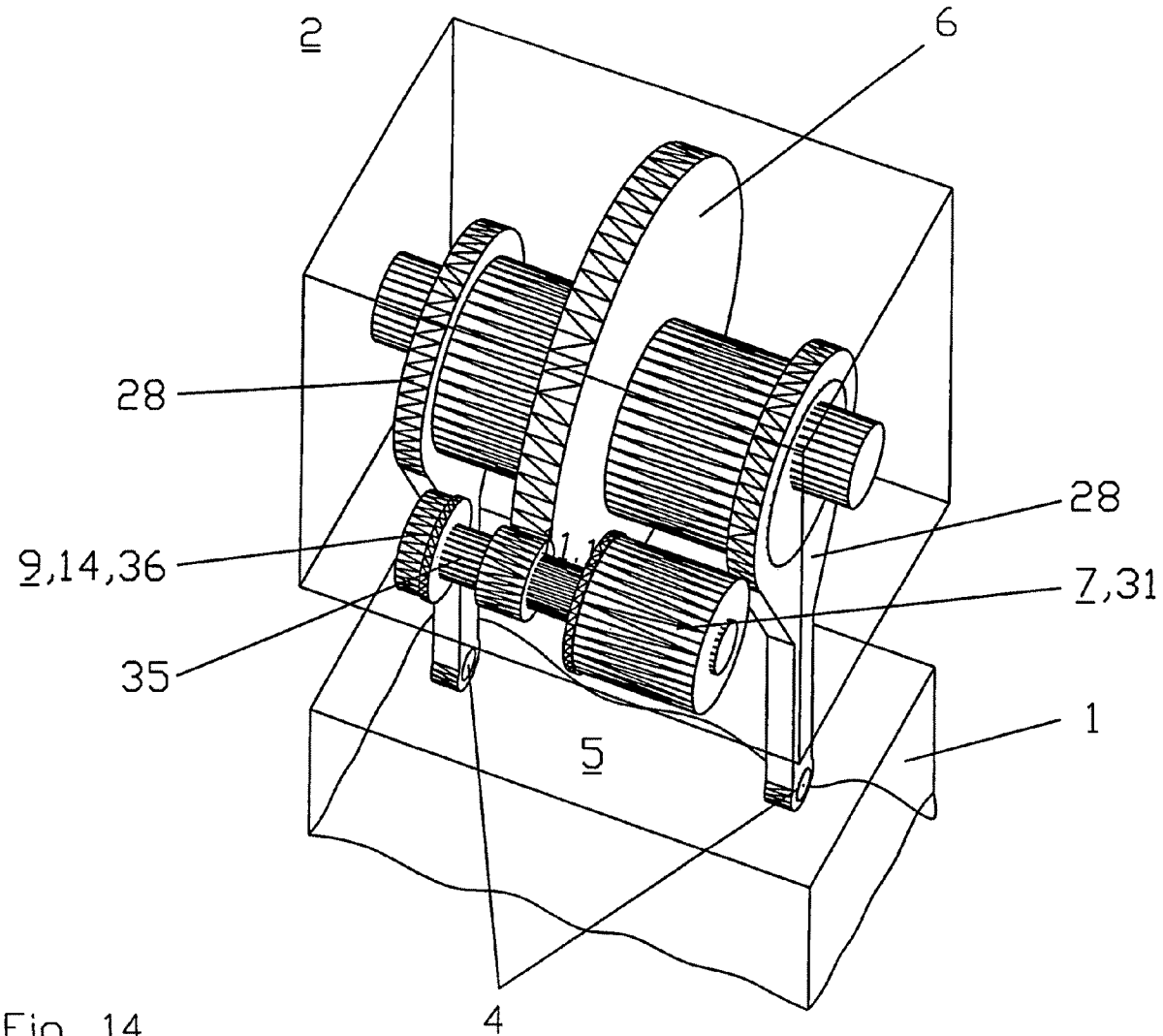
FIG. 14 depicts a drive system for a forming press in a longitudinal shaft arrangement having a mechanically synchronized pressure point group.

The exemplary embodiment in accordance with FIG. 14 describes a forming press with a longitudinal shaft arrangement having two pressure points 4 that are driven by a common, centrally arranged crank wheel 6 via a pinion shaft 35 for a servo-motor 7. The associated retention device 9, in the form of a non-positive fit double brake 36 arranged axially successively, is borne on the opposite end of the pinion shaft 35.

Figure 2:
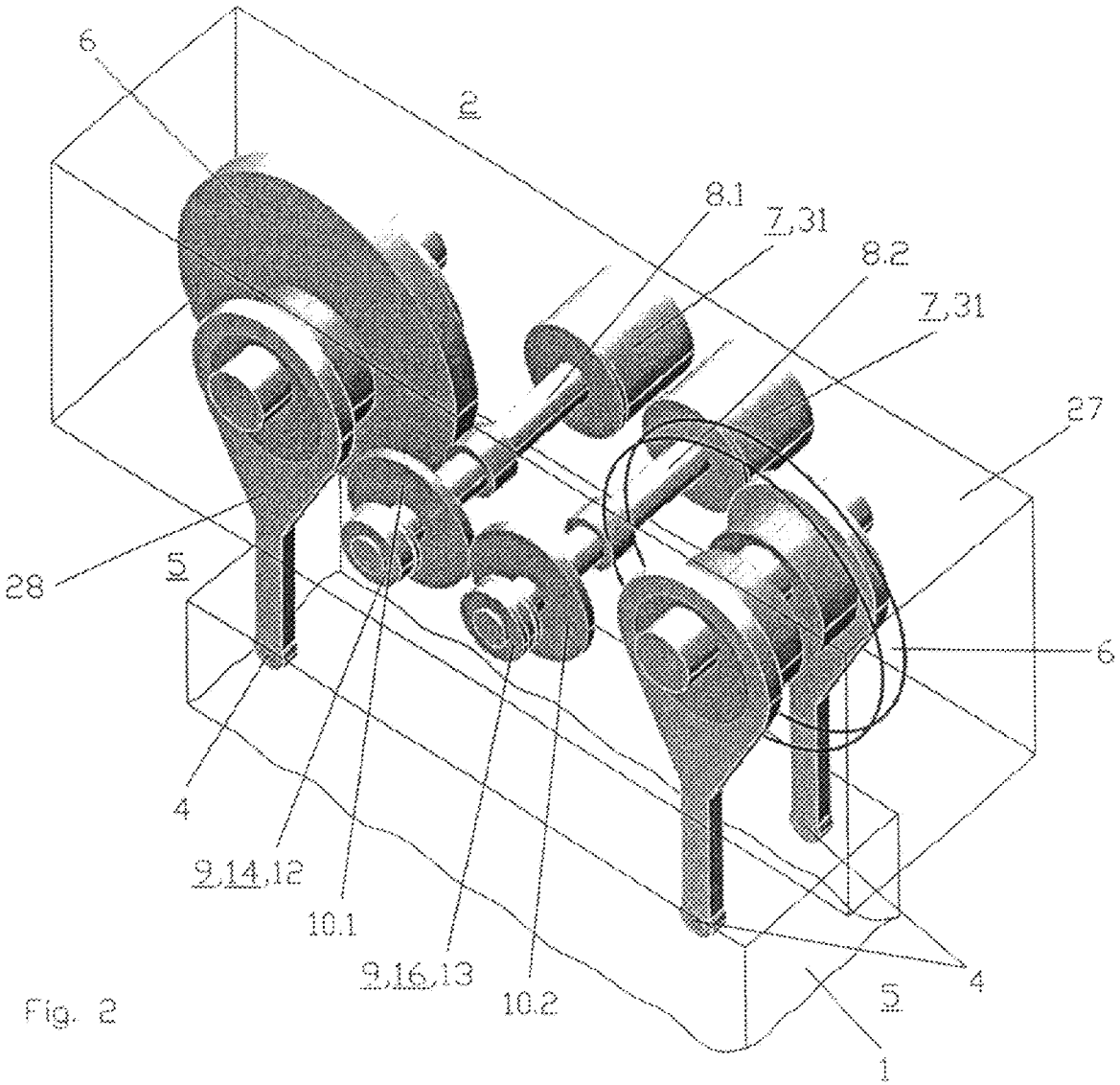
FIG. 2 depicts a drive system for a forming press in accordance with a second design having two mechanically synchronizable pressure point groups.

In the second exemplary embodiment in accordance with FIG. 2, the adjacent crank wheels 6 each act on the pressure points 4 in the case of a two-point forming press or on the pressure point group 5 in the case of a four-point forming press. In the case of a four-point forming press, it is also possible for a separate crank wheel to be allocated to each pressure point. The crank wheels 6 are each driven via a first pinion shaft 8.1, 8.2 by means of a servo-motor 7, mechanical synchronization of the adjacent pressure points 4 or pressure point groups 5 being possible by means of the intermediate gears 10.1, 10.2 arranged coaxially on the pinion shafts 8.1, 8.2.

The retention devices 9 on the front side that are coaxially mechanically linked to the first pinion shafts 8.1, 8.2 are opposite the servo-motors 7 arranged on the back side on the head piece 27. The retention device 9 is embodied on the first piston shaft 8.1 belonging to the left-hand crank wheel 6 as a non-positive fit or non-force fit (the two terms being used interchangeably herein) safety brake 12 and on the first pinion shaft 8.2 belonging to the right-hand crank wheel 6 as a positive-fit rotation blocking unit 16, preferably as a positive fit blocking unit 13. Compared to the safety brake 12 with the non-positive fit active principle, the positive fit active principle of the blocking device 13 can be realized for instance using outer and inner teeth that can be caused to engage.

Figure 3:
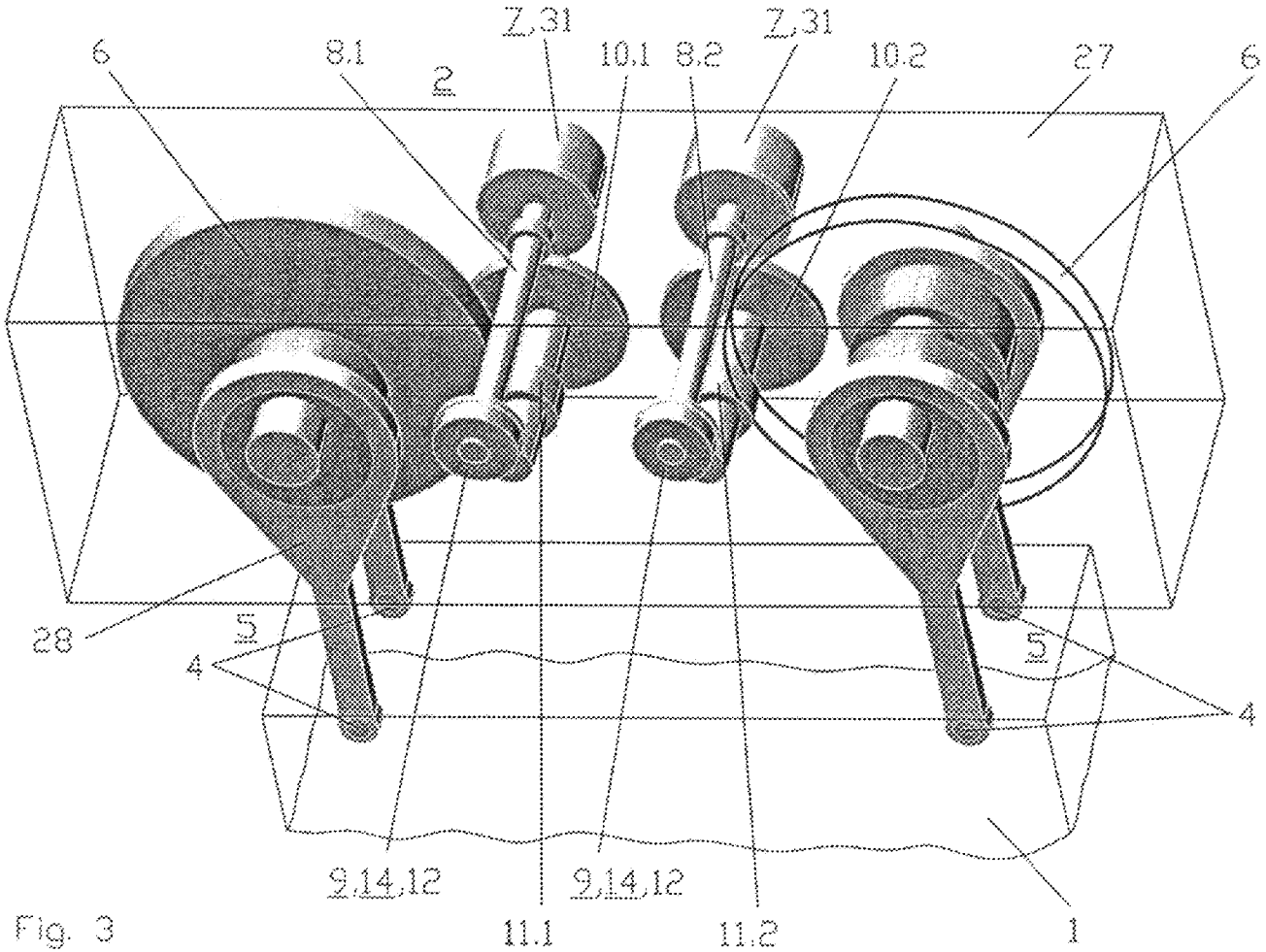
FIG. 3 depicts a drive system for a forming press in accordance with a third design having two electronically synchronizable pressure point groups.
Figure 4:
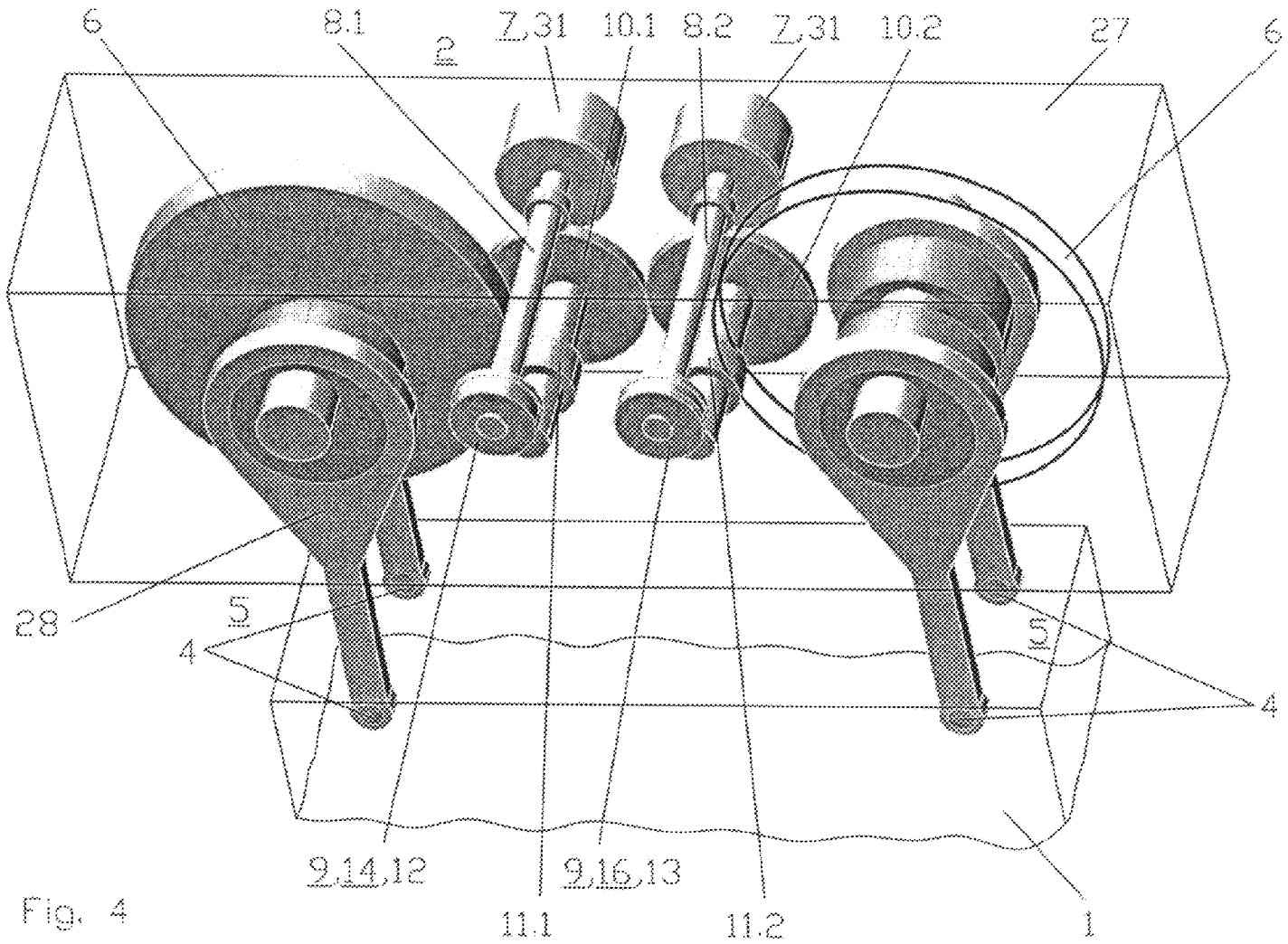
FIG. 4 depicts a drive system for a forming press in accordance with a third design having two mechanically synchronizable pressure point groups.

FIGS. 3 and 4 depict a third embodiment of the drive system in which embodiment, by means of a dual gear transmission, a second pinion shaft 11.1, 11.2 mechanically linked to the associated crank wheel 6 is driven via a coaxially arranged intermediate gear 10.1, 10.2 by a first pinion shaft 8.1, 8.2 that can be controlled by means of a servo-motor 7. The intermediate gears 10.1, 10.2 that are mechanically linked to one another in the embodiment in accordance with FIG. 4 satisfy the additional function of mechanically synchronizing the adjacent pressure points 4.

Furthermore, in the case of a four-point forming press it is possible for a separate crank wheel to be allocated to each pressure point and for the second pinion shafts 11 to act jointly on two crank wheels 6 that are disposed one after the other.

Analogous to the exemplary embodiment in accordance with FIG. 2, the servo-motors 7 that are mechanically linked to the first pinion shafts 8.1, 8.2 are each disposed on the back side and the retention devices 9 are disposed on the front side of the head piece 27. The retention device 9 associated with the pinion shaft 8.1 is embodied as a non-positive fit safety brake 12 and the retention device 9 associated with the pinion shaft 8.2 is embodied as a positive-fit blocking device 13. If the mechanical link between the intermediate gears 10.1, 10.2 is eliminated, according to the embodiment in accordance with FIG. 3 the adjacent pressure points 4 are electronically synchronized. One non-positive fit safety brake 12 is allocated as a retention device 9 to each pinion shaft 8.1 and 8.2.

Figure 5:
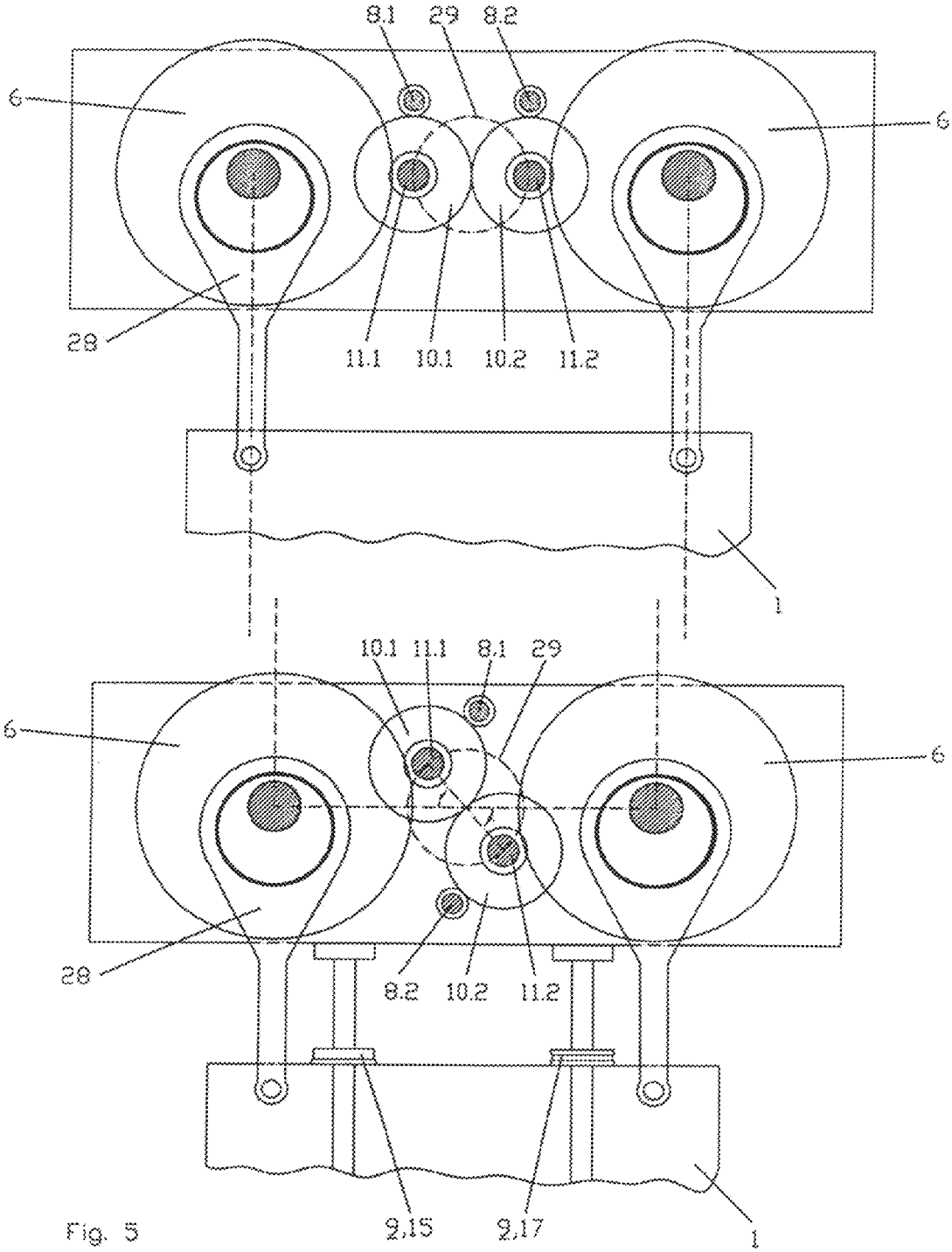
FIG. 5 depicts a drive system for a forming press in accordance with the third design for variable pressure point spacing.

In order to create different spacing between the adjacent pressure points 4 as a function of the structural size of the press, the second pinion shafts 11.1, 11.2 allocated to the crank wheels 6 can be arranged rotated in the same direction about the same angle on a common circular path 29 as in FIG. 5. In the embodiment, alternative to rotating systems, depicted as exemplary retention devices 9 are systems in the form of a linear brake 15 and a linear blocking unit 17 that act linearly on the movement of the slide.

The dual gear transmission described in the foregoing can furthermore be employed in the drive system having the longitudinal shaft arrangement in accordance with FIG. 14.

Figure 6:
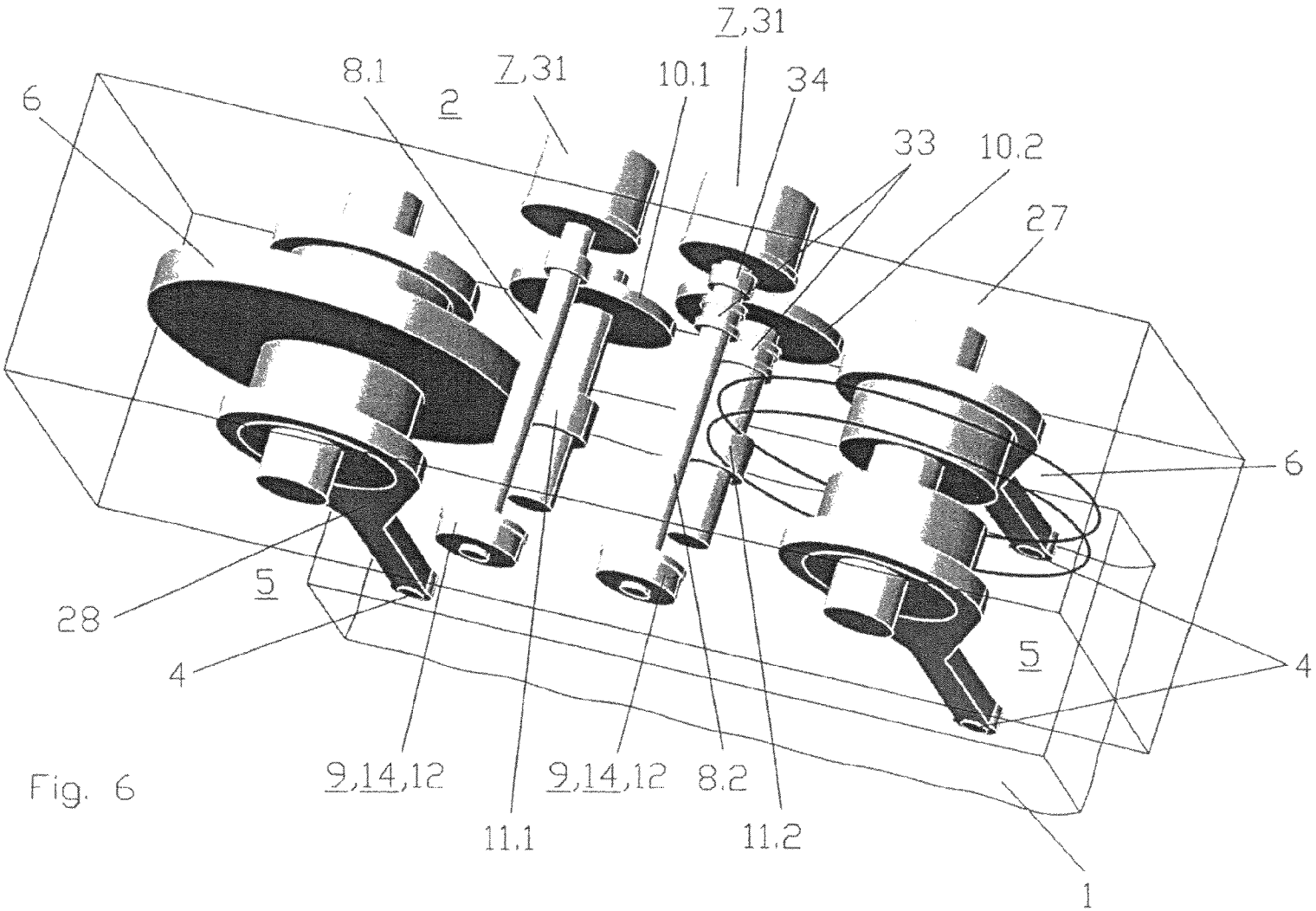
FIG. 6 depicts a drive system for a forming press in accordance with the third design having selectively mechanically and electronically synchronizable pressure point groups.

The third embodiment in accordance with FIG. 4 can advantageously be modified with the option to switch between mechanically and electronically synchronizing the pressure points 4 in that corresponding to FIG. 6, by means of a pushing device 33 for instance the pinion 34 belonging to the second pinion shaft 8.2 and the intermediate gear 10.2 mechanically linked thereto are relatively displaceable on the second pinion shaft 11.2 such that the mechanical link between the intermediate gears 10.1 and 10.2 can be eliminated.

Figure 7:
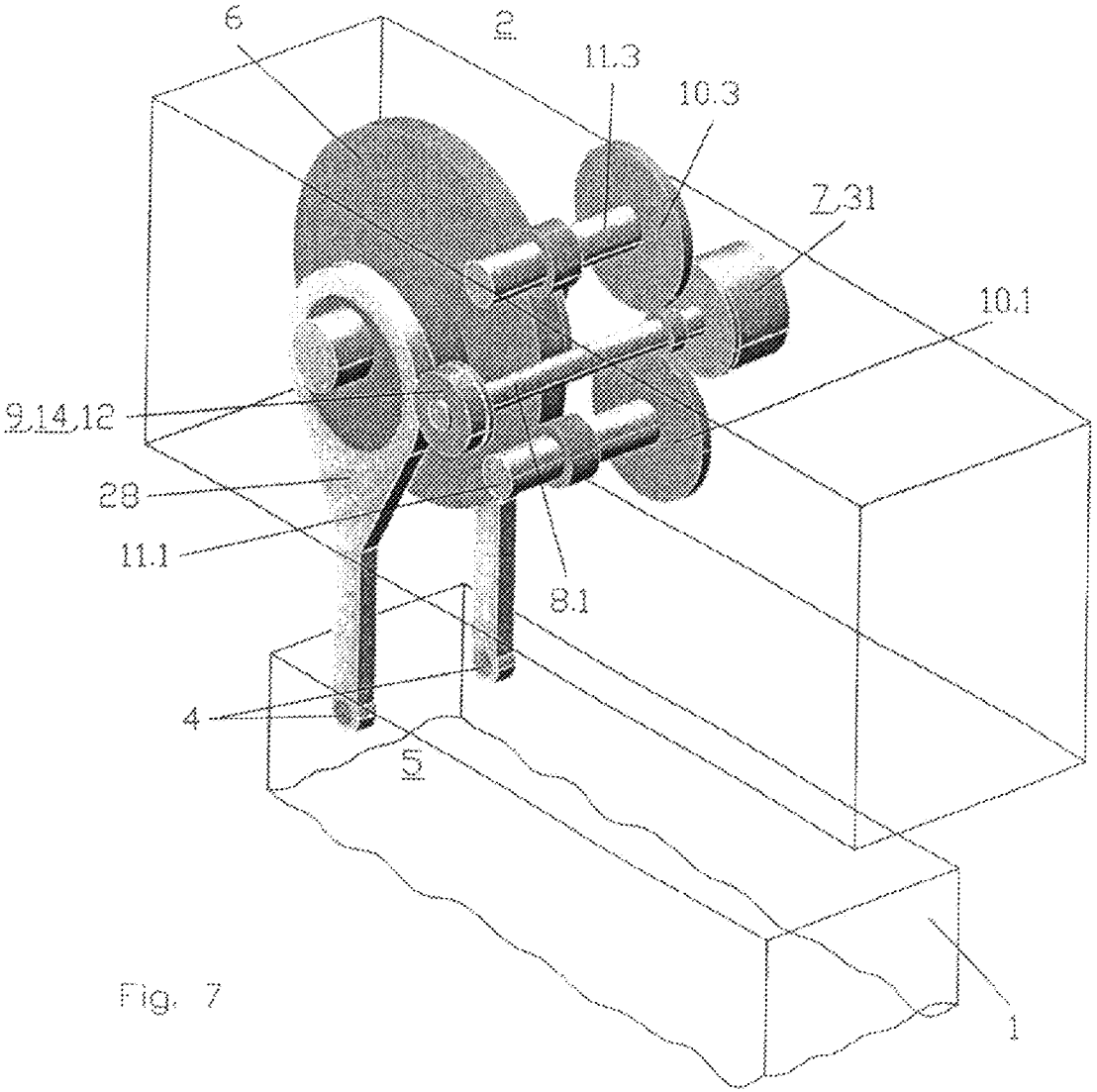
FIG. 7 depicts a drive system for a forming press in accordance with a fourth design having two mechanically synchronizable pressure point groups.

In order to optimize the addition of force to the crank wheels 6, corresponding to the fourth design in accordance with FIG. 7 it is possible with the drive 2, depicted for half a machine, to divide the torques introduced into the crank wheels 6 in that two second pinion shafts 11.1, 11.3 (depicted) and 11.2, 11.4 (not depicted) that are arranged radially offset engage with the respective crank wheel 6. Arranged coaxially on the second pinion shafts 11 are the intermediate gears 10.1, 10.3 (depicted) and 10.2, 10.4 (not depicted), the intermediate gears 10.1, 10.3 being jointly controllable by the first pinion shaft 8.1 and the intermediate gears 10.2, 10.4 by the first pinion shaft 8.2 (not depicted). The intermediate gears 10.1, 10.2 that are mechanically linked to one another assume the additional function of mechanically synchronizing the adjacent pressure points 4. The first piston shafts 8.1, 8.2 can be controlled by the servo-motors 7 arranged on the back side of the head piece 27. Borne on the front side of the head piece 27 are the retention devices 9 that belong to the first pinion shafts 8.1, 8.2 and that are embodied on the first pinion shaft 8.1 as a non-positive fit safety brake 12 (depicted) and on the first pinion shaft 8.2 as a positive-fit blocking device 13 (not depicted).

Figure 8:
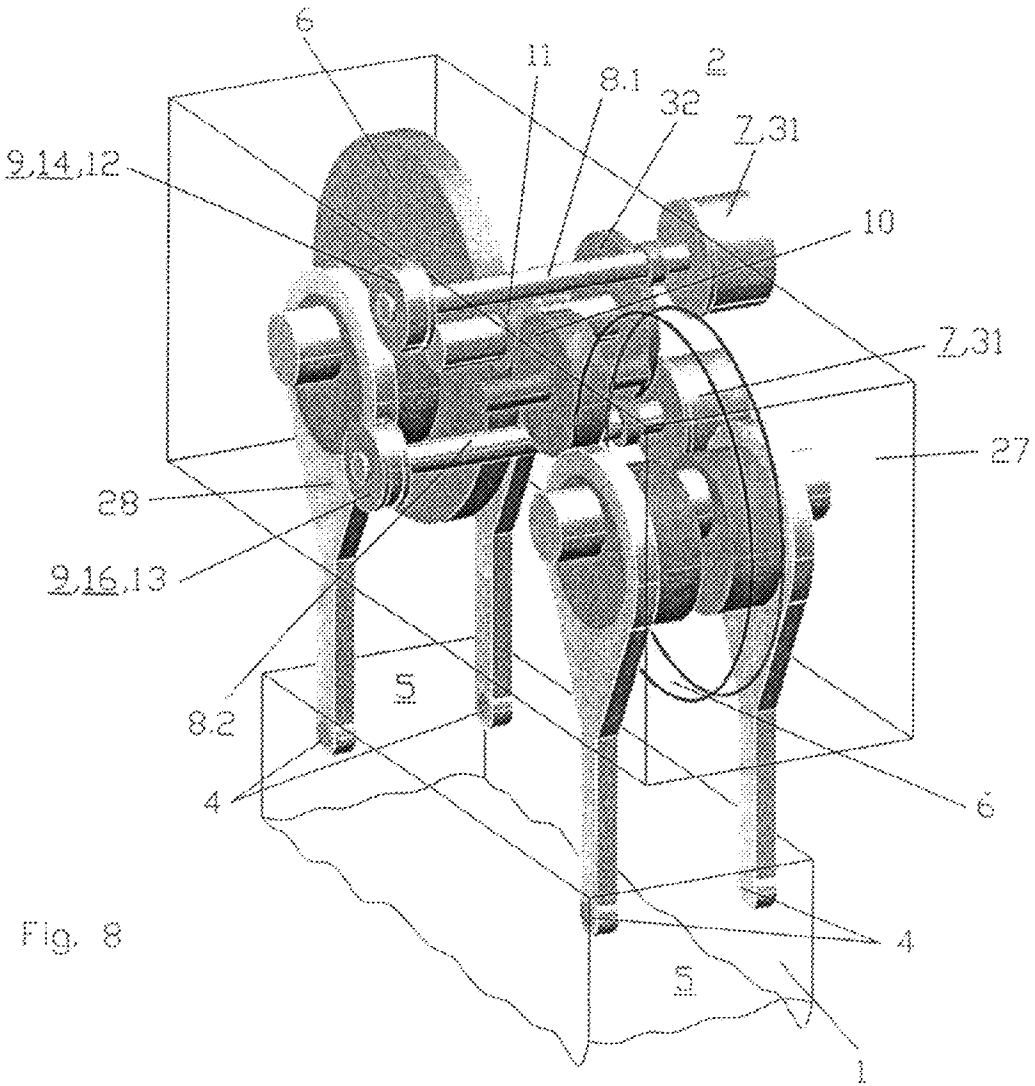
FIG. 8 depicts a drive system for a forming press in accordance with a fifth design having a central drive for adjacent pressure point groups and dual gear transmissions with two first pinion shafts.
Figure 9:
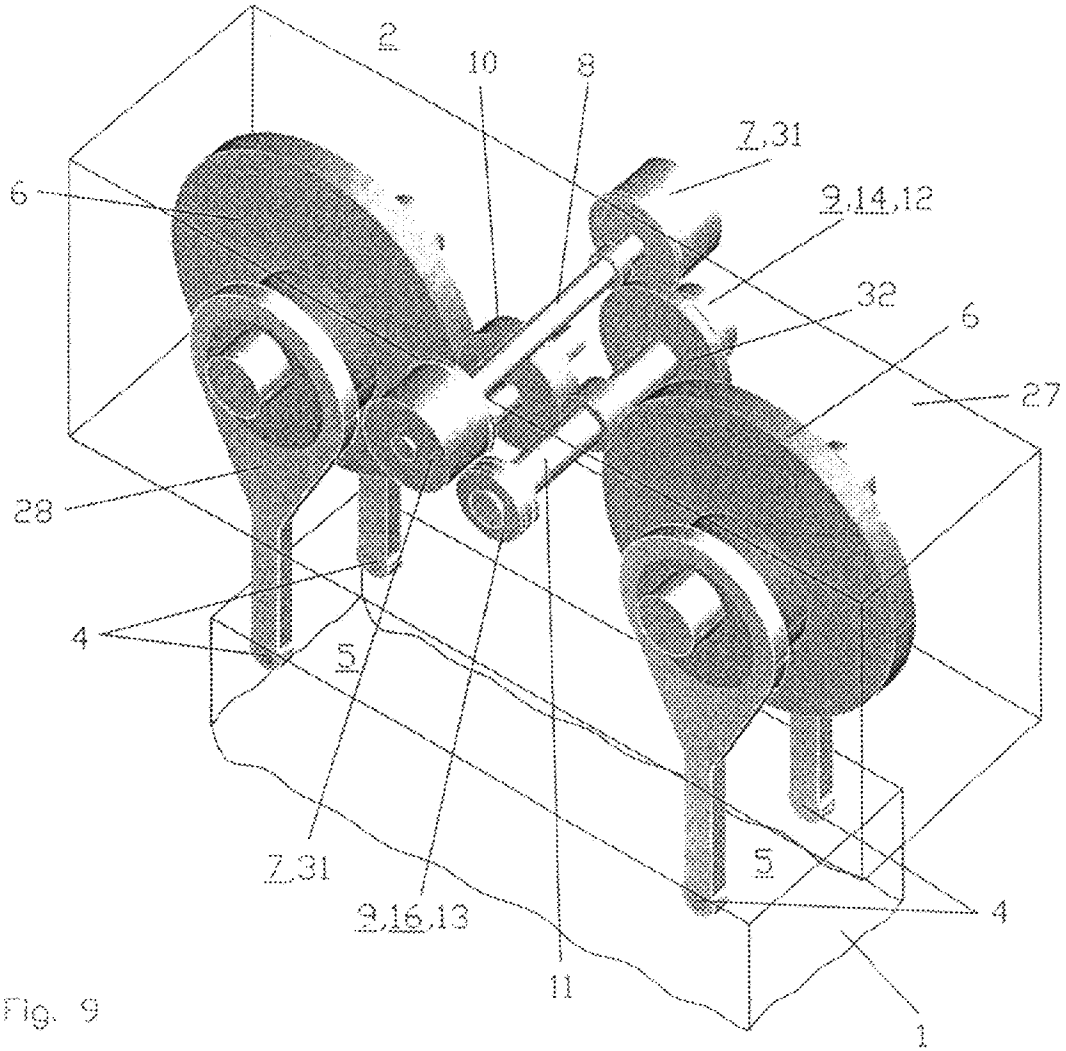
FIG. 9 depicts a drive system for a forming press in accordance with a fifth design having a central drive for adjacent pressure point groups and dual gear transmissions with a first pinion shaft.

FIGS. 8 and 9 describe a drive system in accordance with a first design having a central drive that acts jointly on the adjacent crank wheels 6. To this end, in accordance with FIG. 9, one, or as depicted preferably two, servo-motors 7 arranged coaxially and opposing one another on the first pinion shaft 8, via a gear transmission 32, drive a second pinion shaft 11, the pinion of which is mechanically linked on the one hand to the right-hand crank wheel 6 and on the other hand via an intermediate gear 10 borne separately in the head piece 27 to the adjacent left-hand crank wheel 6. The pressure points 4 are mechanically synchronized via the intermediate gear 10. The non-positive fit safety brake 12 and positive-fit blocking device 13, acting as retention devices 9, are borne on the head piece 27 connected to the second pinion shaft 11.

Compared to the embodiment in accordance with FIG. 9, in order to reduce the torques to be transmitted by the retention devices 9, in the alternative exemplary embodiment in accordance with FIG. 8 the retention devices 9 are arranged on the high-speed motor shafts. Two first pinion shafts 8.1, 8.2 that are arranged offset to one another jointly drive the gear transmission wheel 32 that is disposed on the second pinion shaft 11. Each of the first pinion shafts 8.1, 8.2 is controlled by a servo-motor 7 that is borne on the back side of the head piece 27. The associated retention devices 9 are each borne coaxially on the first pinion shaft 8.1, 8.2 opposite the servo-motors 7 on the front side of the head piece 27. The retention device 9 of the pinion shaft 8.1 is embodied in the form of a rotation brake 14 as a non-positive fit safety brake 12 and that of the pinion shaft 8.2 is embodied in the form of a rotation blocking unit 16 as a positive-fit blocking device 13. Analogous to FIG. 9, the pinion of the second pinion shaft 11 is on the one hand mechanically linked to the left-hand crank wheel 6 and on the other hand via the intermediate gear 10 borne separately in the head piece 27 to the adjacent right-hand crank wheel 6. For reducing the torques on the retention devices it is likewise possible, analogous to the embodiment in accordance with FIG. 9, in addition to the first pinion shaft 8 that can be controlled using two servo-motors 7, to arrange the non-positive fit safety brake 12 belonging to the retention device 9 and the positive-fit blocking device 13 coaxially and opposing one another on another first pinion shaft, both first pinion shafts being mechanically linked to the gear transmission wheel 32 arranged on the second pinion shaft 11, analogous to the embodiment in accordance with FIG. 8.

Figure 15:
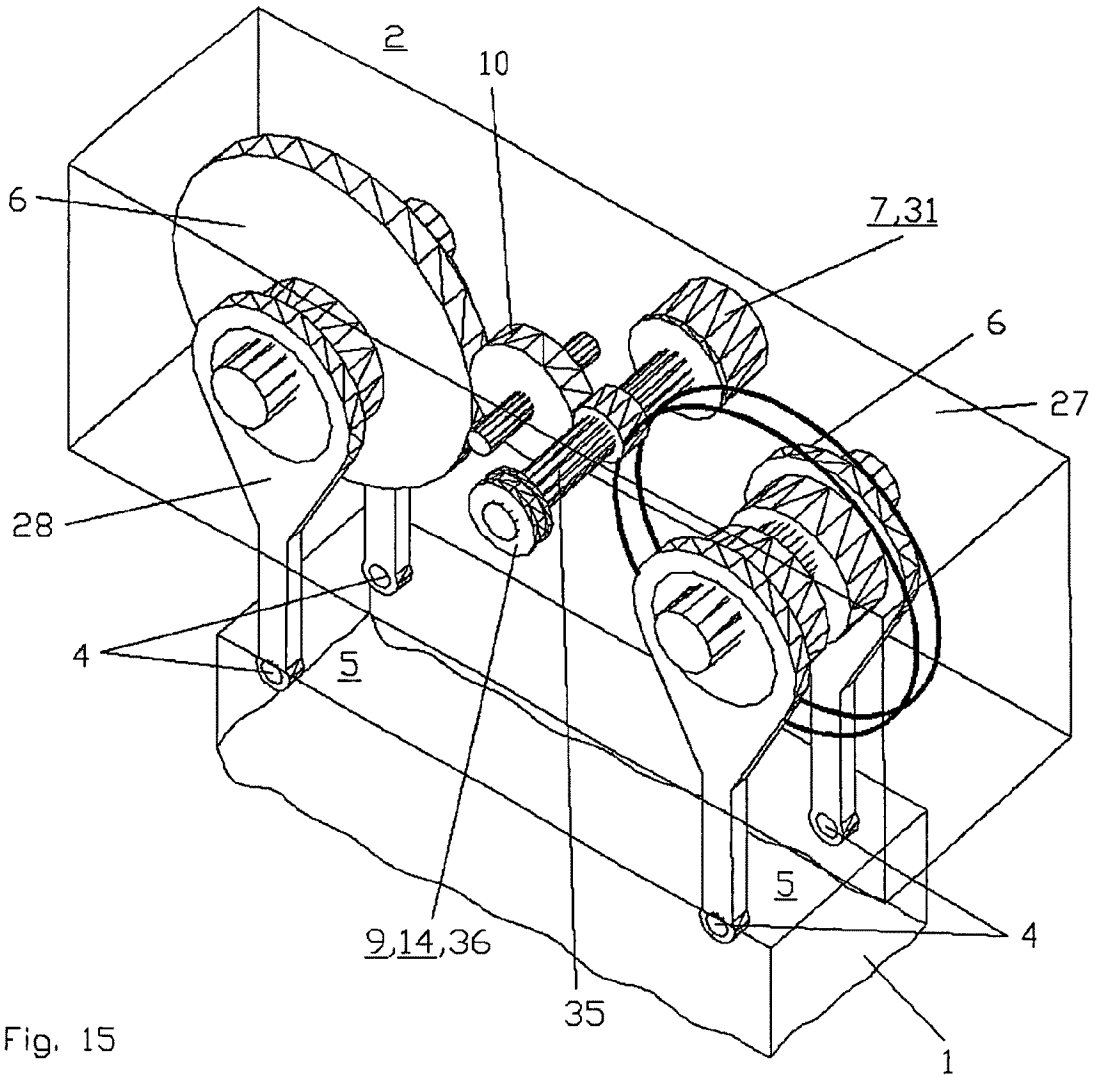
FIG. 15 depicts a drive system for a forming press in accordance with a fifth design having a central drive for adjacent pressure point groups and a single gear transmission.

In another embodiment of the fifth design, in accordance with FIG. 15 the drive system with central drive for adjacent pressure point groups is embodied with a single gear transmission. The pinion shaft 35 is mechanically linked on the one hand to the right-hand crank wheel 6 and on the other hand to the intermediate gear 10 synchronizing the two crank wheels 6. The pinion shaft 35 is driven by a servo-motor 7. The associated retention device 9, in the form of a non-positive fit double brake 36 that is arranged axially successively is borne on the opposite end of the pinion shaft 35.

Moreover, in the case of a four-point forming press it is possible for a separate crank wheel to be allocated to each pressure point and for the pinion shaft 11, 35 to act with associated pinions jointly on two crank wheels 6 that are disposed one after the other.

In this case, for mechanically synchronizing the adjacent pressure points, the two pinions arranged on the pinion shaft 11, 35 are each mechanically linked with an intermediate gear 10.

In all of the embodiments, the servo-motors 7 attain flexible path and speed profiles for the movement of the slide 1, the target positions of the slide 1 preferably being produced using guidewave-controlled electronic cam disks. In terms of the path profile, it is possible to choose between a 360° cycle movement, a reversible movement at an angle <360° with passage through the bottom reversal point, or a movement at an angle <180° with reversal in the area of the bottom reversal point. The latter operating mode can preferably be used in conjunction with the tilt control for the slide 1, which is possible with electronic synchronization of the pressure points 4, in one plane for a two-point forming press or in two planes for a four-point forming press.

It is also true of all of the embodiments that for satisfying the personnel safety requirements the slide 1 is securely retained using a combination of a retention device 9 and a device for torque isolation 18. For the mechanical retention devices 9, either two independently acting non-positive fit safety brakes 12 can be used in accordance with the exemplary embodiments according to FIGS. 1, 3, 6, 7, or at least one non-positive fit safety brake 12 and one positive fit blocking device 13 can be used in accordance with the exemplary embodiments according to FIGS. 2, 4, 5, 8, these securely locking and unlocking the slide 1 in any desired position without a time delay. The functioning of the retention devices 9 is monitored cyclically and redundantly and they are integrated into the press safety control unit. To this end, in the non-positive fit, preferably spring-actuated safety brakes 12 on the one hand, for controlling the spring force, the braking force on the servo-motor actuated with a defined drive torque when idle is controlled using current measurement and on the other hand the final position of the brake piston in the brake pitch is monitored in the unlocked position. The safety control unit compares the monitoring signals to prespecified limiting values.

To supplement the measures described in the foregoing for stopping and retaining the slide 1, for satisfying engineering safety requirements, in particular for preventing impermissible loads, it is possible on the one hand to limit the torque of the servo-motors 7 with or without direct force measurement and on the other hand to provide overload elements in the gear chain. In addition to the overload safety devices that are equipped with a hydraulic cushion and that are in the pressure points 4 of the slide 1, where needed at least one rotationally acting overload element can be provided in the rotating part of the gear chain. The overload safety device is linked via the safety control unit 26 to the control for the servo-motors 7 in order to provide additional braking for the drive if there is an overload.

Figure 10:
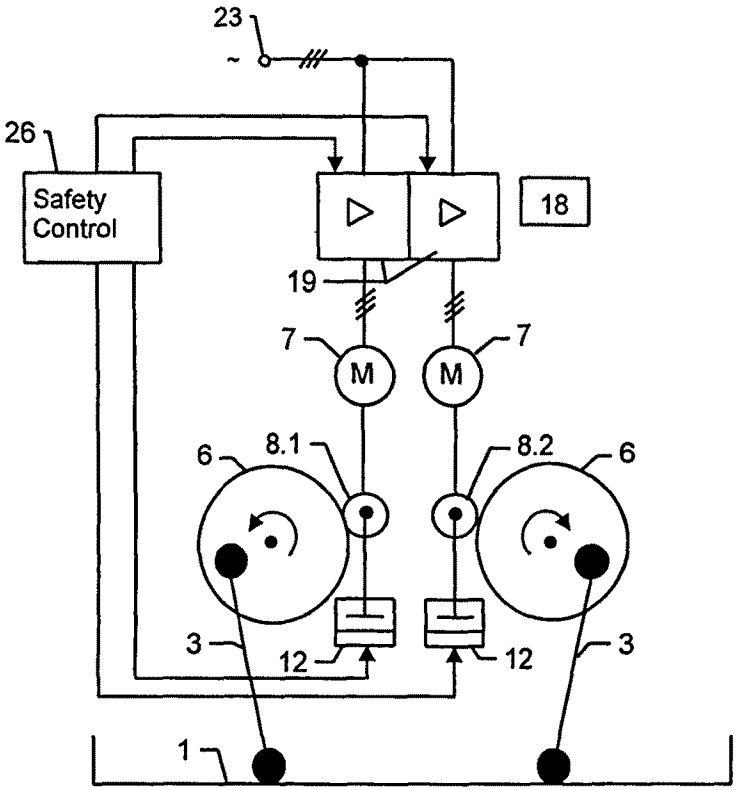
FIG. 10 depicts a safety device that is a combination of a retention device and a device for torque isolation in accordance with a first design.
Figure 12:
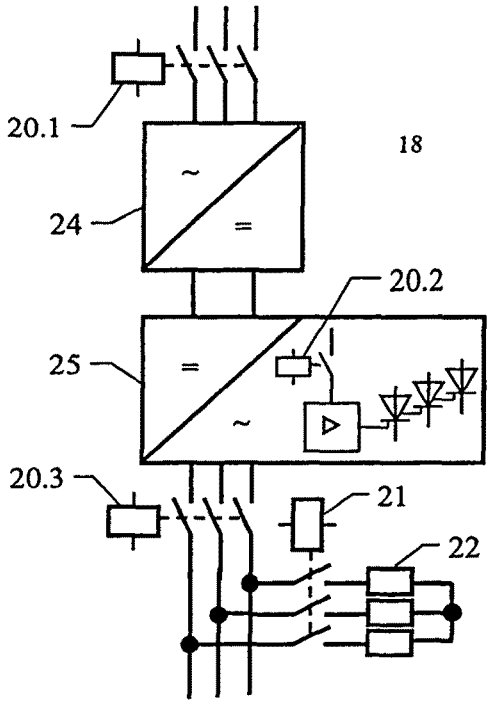
FIG. 12 provides a detail view of the device for torque isolation from FIGS. 10 and 11.

FIG. 10 depicts the safety device in a combination of a retention device 9 and a device for torque isolation 19 in accordance with a first design corresponding to the drive system for instance according to the exemplary embodiment having electronically synchronizable pressure points according to FIG. 1 or 3. The crank wheels 6 can be controlled independently of one another via the first pinion shaft 8.1, 8.2 by the respective servo-motor 7. A non-positive fit safety brake 12 is allocated to both pinion shafts 8.1, 8.2 as the retention device 9.

Figure 11:
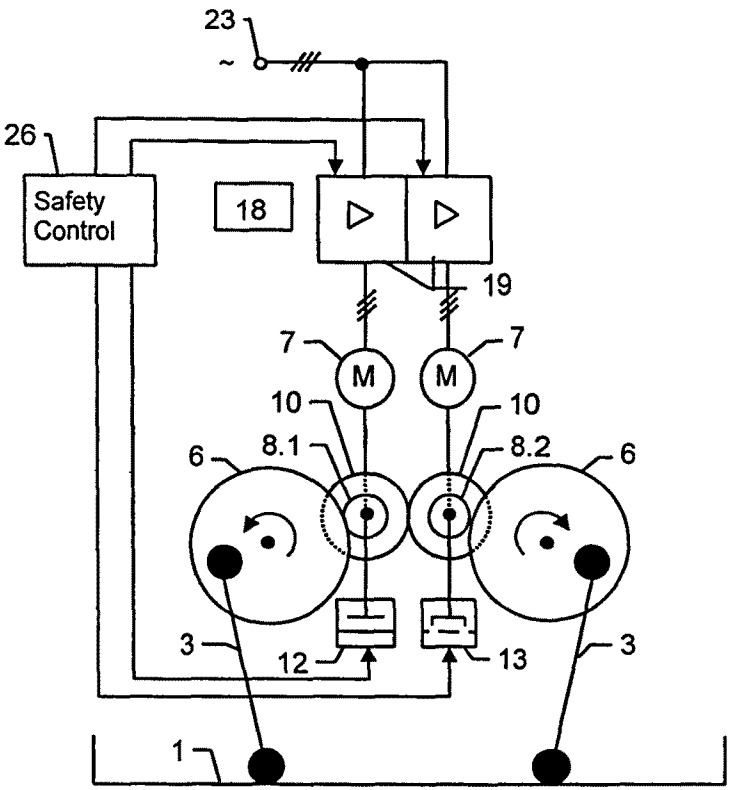
FIG. 11 depicts a safety device that is a combination of a retention device and a device for torque isolation in accordance with a second design.

The second design for the safety device in accordance with FIG. 11 is essentially distinguished from the first design in that, corresponding to the exemplary embodiments described in the foregoing that have mechanically synchronizable pressure points according to FIG. 2, 5, 7, 8, or 9, the first pinion shaft 8.1 is mechanically linked to a non-positive fit safety brake 12 and the second pinion shaft 8.2 is mechanically linked to a positive-fit blocking device 13 as the retention device 9. In both designs the servo-motors 7 are controlled via the servo-converter system 18, fed by the power supply 23, with the integrated device for torque isolation 19.

For satisfying the personnel and engineering safety requirements, the mechanical retention devices 9 and the devices for electrical torque isolation 19 act in combination and are controlled and monitored jointly by the safety control unit 26. The torque isolation unit 19, which is necessary for preventing uncontrolled start-up of the servo-motors 7, can be created using the following measures that can be seen in FIG. 11 individually or in combination. In addition to the line contactor 20.1 that can be embodied to be turned off and that is in the servo-converter system 8 in a first embodiment, a power contactor 20.3 that can be turned off can be used in the motor line in a second embodiment. A turn-off element 20.2 for the control energy of the semi-conductor gates of the motor AC converter 25 can be used for torque isolation in a third embodiment. It is also conceivable to short-circuit the motor line, by means of a short circuit protection unit 21, in conjunction with load resistors 22.

The invention claimed is:

1. A drive system for driving a slide of a forming press, comprising a crank mechanism including at least one first crank wheel and at least one second crank wheel, at least one connecting rod operatively connected to each respective crank wheel and each connecting rod having a distal end connected to and forming a pressure point at the slide, one or more servo-motors operatively connected to the crank mechanism, a retention device and a device for torque isolation, and a first pinion shaft mechanically linked to the at least one first crank wheel on the one hand and to the at least one second crank wheel on the other hand via at least one intermediate gear, wherein the retention device and the device for torque isolation are linked to the at least one servo-motor and the mechanical link of the first pinion shaft to the crank wheels is direct engagement and the first pinion shaft is controlled directly by at least one of the servo-motors or the mechanical link of the first pinion shaft to the crank wheels comprises a second pinion shaft directly controlled by at least one of the servo-motors and a gear transmission wheel through which the first pinion shaft is driven indirectly and the mechanical link of the crank wheels comprises an intermediate gear and the first pinion shaft or the gear transmission wheel mechanically links at least one first or second pinion shaft directly controlled by at least one of the servo-motors to at least one first or second pinion shaft not directly controlled by at least one of the servo-motors.

2. A drive system according to claim 1, wherein respective ones of first or second crank wheels are each driven by a respective first pinion shaft, the respective first pinion shafts are radially offset from the other and each is controlled directly by a respective one of the servo-motors and each of the servo-motors is linked to a respective ones of the retention device and the device for torque isolation.

3. A drive system according to claim 1, wherein the mechanical link of the first pinion shaft to the crank wheels is direct engagement, the first pinion shaft is controlled directly by at least one of the servo-motors, the drive system comprises the intermediate gear and the intermediate gear is arranged on the first pinion shaft coaxially therewith and each of the servo-motors is linked to a respective ones of the retention device and the devices for torque isolation.

4. A drive system according to claim 1, wherein each of the second pinion shafts is mechanically linked to one of the crank wheels associated with a group of pressure points or to two of the crank wheels, each of the first pinion shafts is directly controlled by at least one of the servo-motors and respective ones of the gear transmission wheel are arranged on respective ones of the second pinion shafts coaxially therewith and mechanically link respective ones of the second pinion shafts to respective ones of the first pinion shafts.

5. A drive system according to claim 1, wherein two of the second pinion shafts act jointly on one of the crank wheels, respective ones of the gear transmission wheel are arranged on respective ones of the two second pinion shafts and one of the first pinion shafts, directly controlled by one of the servo-motors, drives the two second pinion shafts via the gear transmission wheel.

6. A drive system according to claim 4 or 5, wherein respective ones of the second pinion shafts act on respective ones of the crank shafts, respective ones of the gear transmission wheel are arranged on respective ones of the second pinion shafts coaxially therewith and the gear transmission wheels are mechanically linked.

7. A drive system according to any one of claims 3 to 5, wherein at least one of the intermediate gears is axially displaceable as a function of operating mode.

8. A drive system according to claim 1, further comprising a rotational overload element.

9. A drive system according to claim 1, wherein the first and the second pinion shafts are associated with respective adjacent pressure points and are arrangeable rotated about a same angle on a common circular path as a function of structural size of the press.

10. A drive system according to claim 1, wherein the servo-motors are hollow shaft motors.

11. A drive system for driving a slide of a forming press, comprising a crank mechanism including at least one first crank wheel and at least one second crank wheel, at least one connecting rod operatively connected to each respective crank wheel and each connecting rod having a distal end connected to and forming a pressure point at the slide, one or more servo-motors operatively connected to the crank mechanism, a retention device and a device for torque isolation, a first pinion shaft mechanically linked to the at least one first crank wheel on the one hand and to the at least one second crank wheel on the other hand and a servo-converter system and the device for torque isolation comprises a line contactor in the servo-converter system, the line contactor being capable of being turned off and/or the drive system further comprises a motor AC converter having semiconductor gates and a turn-off element for the central energy for the semiconductor gates and/or the drive system further comprises a power contactor in a power line for the motor, the power contactor being capable of being turned off, wherein the retention device and the device for torque isolation are mechanically linked to the at least one servo-motor and the mechanical link of the first pinion shaft to the crank wheels is direct engagement and the first pinion shaft is controlled directly by at least one of the servo-motors or the mechanical link of the first pinion shaft to the crank wheels comprises a second pinion shaft directly controlled by at least one of the servo-motors and a gear transmission wheel or intermediate gear-through which the first pinion shaft is driven indirectly or the gear transmission wheel mechanically links at least one first or second pinion shaft directly controlled by at least one of the servo-motors to at least one first or second pinion shaft not directly controlled by at least one of the servo-motors.

12. A drive system according to claim 11, further comprising an intermediate circuit for the converter and load resistors capable of short-circuiting the motor line or the converter intermediate circuit.

13. A drive system for driving a slide of a forming press, comprising a crank mechanism including at least one first crank wheel and at least one second crank wheel, at least one connecting rod operatively connected to each respective crank wheel and each connecting rod having a distal end connected to and forming a pressure point at the slide, one or more servo-motors operatively connected to the crank mechanism, a retention device and a device for torque isolation, and a first pinion shaft mechanically linked to the at least one first crank wheel on the one hand and to the at least one second crank wheel on the other hand, wherein the retention device and the device for torque isolation are mechanically linked to the at least one servo-motor and the mechanical link of the first pinion shaft to the crank wheels is direct engagement and the first pinion shaft is controlled directly by at least one of the servo-motors or the mechanical link of the first pinion shaft to the crank wheels comprises a second pinion shaft directly controlled by at least one of the servo-motors and a gear transmission wheel or intermediate gear through which the first pinion shaft is driven indirectly or the gear transmission wheel mechanically links at least one first or second pinion shaft directly controlled by at least one of the servo-motors to at least one first or second pinion shaft not directly controlled by at least one of the servo-motors, the retention device comprising two independently acting non-positive or non-force fit safety brakes.

14. A drive system according to claim 13, wherein the non-positive or non-force fit safety brakes are rotation brakes each arranged on the first pinion shafts or other pinion shaft controlled directly by at least one servo-motor, each of the safety brakes being coaxial with the shaft on which it is arranged.

15. A drive system according to claim 14, wherein the rotation brakes are double brakes.

16. A drive system according to claim 13, wherein the non-positive or non-force fit safety brakes are linear brakes mechanically linked to the slide.

17. A drive system for driving a slide of a forming press, comprising a crank mechanism including at least one first crank wheel and at least one second crank wheel, at least one connecting rod operatively connected to each respective crank wheel and each connecting rod having a distal end connected to and forming a pressure point at the slide, one or more servo-motors operatively connected to the crank mechanism, a retention device and a device for torque isolation, and a first pinion shaft mechanically linked to the at least one first crank wheel on the one hand and to the at least one second crank wheel on the other hand, wherein the retention device and the device for torque isolation are mechanically linked to the at least one servo-motor and the mechanical link of the first pinion shaft to the crank wheels is direct engagement and the first pinion shaft is controlled directly by at least one of the servo-motors or the mechanical link of the first pinion shaft to the crank wheels comprises a second pinion shaft directly controlled by at least one of the servo-motors and a gear transmission wheel or intermediate gear through which the first pinion shaft is driven indirectly or the gear transmission wheel mechanically links at least one first or second pinion shaft directly controlled by at least one of the servo-motors to at least one first or second pinion shaft not directly controlled by at least one of the servo-motors, the retention device comprising at least one non-positive or non-force fit safety brake and one positive fit blocking device.

18. A drive system according to claim 17, wherein each of the non-positive or non-force fit safety brakes is a rotation brake, the positive fit blocking device is a rotation blocking device and each of the rotation brakes and each of the rotation blocking devices are arranged on the first pinion shafts or other pinion shaft controlled directly by at least one servo-motor, each of the rotation blocking devices being coaxial with the shaft on which it is arranged.

19. A drive system according to claim 17, wherein each of the non-positive or non-force fit safety brakes is a linear brake and the positive fit blocking device is a linear blocking device and each of the linear brakes and the linear blocking device is mechanically linked to the slide.

20. A drive system according to claim 13 or 17, further comprising a safety control unit for monitoring function of the non-force or non-positive fit safety brakes cyclically and redundantly by controlling braking force through current measurements on the servo-motors actuated with a defined drive torque in idle and a path-dependent switch is incorporated into the safety control unit whereby wear is controlled.

* * * * *